US005944552A

United States Patent [19]

Hanami

[11] Patent Number: 5,944,552

[45] Date of Patent: Aug. 31, 1999

[54] MULTIPLE TIER ELECTRICAL CONNECTOR

[75] Inventor: Chiyoki Hanami, Tokyo, Japan

[73] Assignee: Hirose Electric Co., Ltd., Tokyo, Japan

[21] Appl. No.: 08/917,229

[22] Filed: Aug. 25, 1997

[30] Foreign Application Priority Data

Aug. 30, 1996 [JP] Japan ..... 8-246884

[51] Int. Cl.[6] ..... H01R 13/58

[52] U.S. Cl. ..... 439/465; 439/942

[58] Field of Search ..... 439/425, 418, 439/460, 465, 404, 405, 942, 676, 344

[56] References Cited

U.S. PATENT DOCUMENTS 4,601,530 7/1986 Coldren et al. ..... 439/460

5,603,634 2/1997 Ichikawa et al. ..... 439/404

5,683,268 11/1997 Drach et al. ..... 439/404

FOREIGN PATENT DOCUMENTS 5824908 5/1983 Japan .

*Primary Examiner*—Paula Bradley
*Assistant Examiner*—Alexander Gilman
*Attorney, Agent, or Firm*—Kanesaka & Takeuchi

[57] ABSTRACT

A multiple tier electrical connector includes a housing (2) having a plurality of lower arranging grooves (8) for receiving a lower row of cables; a plurality of guiding sections (8C) provided on upper portions of the lower arranging grooves; an arranging member (4) having a plurality of upper arranging grooves (12) for receiving an upper row of cables and a plurality of downward guiding projections (11) for entering the guiding sections.

1 Claim, 10 Drawing Sheets

MULTIPLE TIER ELECTRICAL CONNECTOR

BACKGROUND OF THE INVENTION

1. Field of the Invention

The present invention relates to electrical connectors by which a plurality of rows of cables are arranged in multiple tiers.

2. Description of the Related Art

Conventional electrical connectors of this type have an arranging housing for arranging cables and a holding housing having a plurality of contact elements and holding the cables when both the arranging and holding housings are united.

In FIG. 12, the arranging housing includes a U-shaped housing body 51 and a U-shaped arranging member 52. The housing body 51 has a pair of legs 53 with engaging hooks 53A. The legs 53 are flexible outwardly. A plurality of semi-circular arranging grooves 54 are provided in the bottom of the housing body 51 for arranging a row of cables C1. The arranging member 52 has a flat lower face 52A resting on flat supports 51A provided on opposite sides of the arranging grooves 54 such that the arranging member 52 is supported closely to the lower tier cables C1. A plurality of arranging grooves 55 are provided in the bottom of the arranging member 52 for receiving a row of cables C2.

To assemble the connector, a plurality of cables C1 are arranged in the arranging grooves 54 of the housing body 51, the arranging member 52 is placed at a predetermined position in the housing body 51, and then cables C2 are arranged in the arranging grooves 55 of the arranging member 52 to provide two tiers of arranged cables.

The housing body 51 is then united with a holding housing (not shown). The holding housing is snapped by the engaging hooks 53A of the housing body 51 such that the contact elements of the holding housing are press-connected to the cables of the upper and lower tiers within a cavity of the holding housing. The press-connection sections are offset in the axial direction of cables. By arranging the cables in two tiers it is possible to provide dense wiring.

Frequently, the circuit board on which the electrical connector is mounted is placed closely parallel to another circuit board. Consequently, there is a demand for a low-profile electrical connector.

However, the arranging member 52 is placed above the lower tier of cables so that the height of the connector is no less than the sum of the two tiers of cables and the bottoms of the housing body 51 and the arranging member 52. Since the arranging grooves are semi-circular, it is difficult to hold cables therein.

To secure cables in the arranging grooves, it is necessary to provide sufficiently deep grooves in the housing body and the arranging member. This, however, increases the height of the arranging member and is contradict to the demand.

SUMMARY OF THE INVENTION

Accordingly, it is an object of the invention to provide a low-profile electrical connector capable of securing cables in multiple tiers.

According to the invention there is provided a multiple tier electrical connector, which includes a housing having a plurality of lower arranging grooves for receiving a lower row of cables; a plurality of guiding sections provided on upper portions of the lower arranging grooves; an arranging member having a plurality of upper arranging grooves for receiving an upper row of cables and a plurality of downward guiding projections for entering the guiding sections.

Preferably, the guiding projections have a sufficient length to place a pressure on the cables in the lower arranging grooves.

First of all, a plurality of cables are arranged in the lower arranging grooves, the arranging member is placed, and then a plurality of other cables are arranged in the arranging grooves of the arranging member. The holding housing or member is then placed to secure the cables such that the contact elements of the holding housing are press-connected to the cables.

According to another aspect of the invention there is provided a multiple tier electrical connector, which includes a housing having a plurality of lower arranging grooves for holding a lower row of cables; a plurality of pairs of projections to form a receiving cavity therebetween; a plurality of guiding sections provided on the projections and communicating with the lower arranging grooves; an arranging member having a plurality of upper arranging grooves for receiving an upper row of cables and a downward engaging section for entering the receiving cavity.

The arranging grooves of the arranging member hold an upper row of cables, and the engaging projection enters the receiving cavity of the housing to hold the lower row of cables. The guiding sections of the housing and the engaging section of the arranging member are offset in the axial direction of cables so that the arranging grooves are lowered without losing the strength of the arranging member, thus reducing the height of the arranging member.

DESCRIPTION OF THE PREFERRED EMBODIMENT

Figure 1:
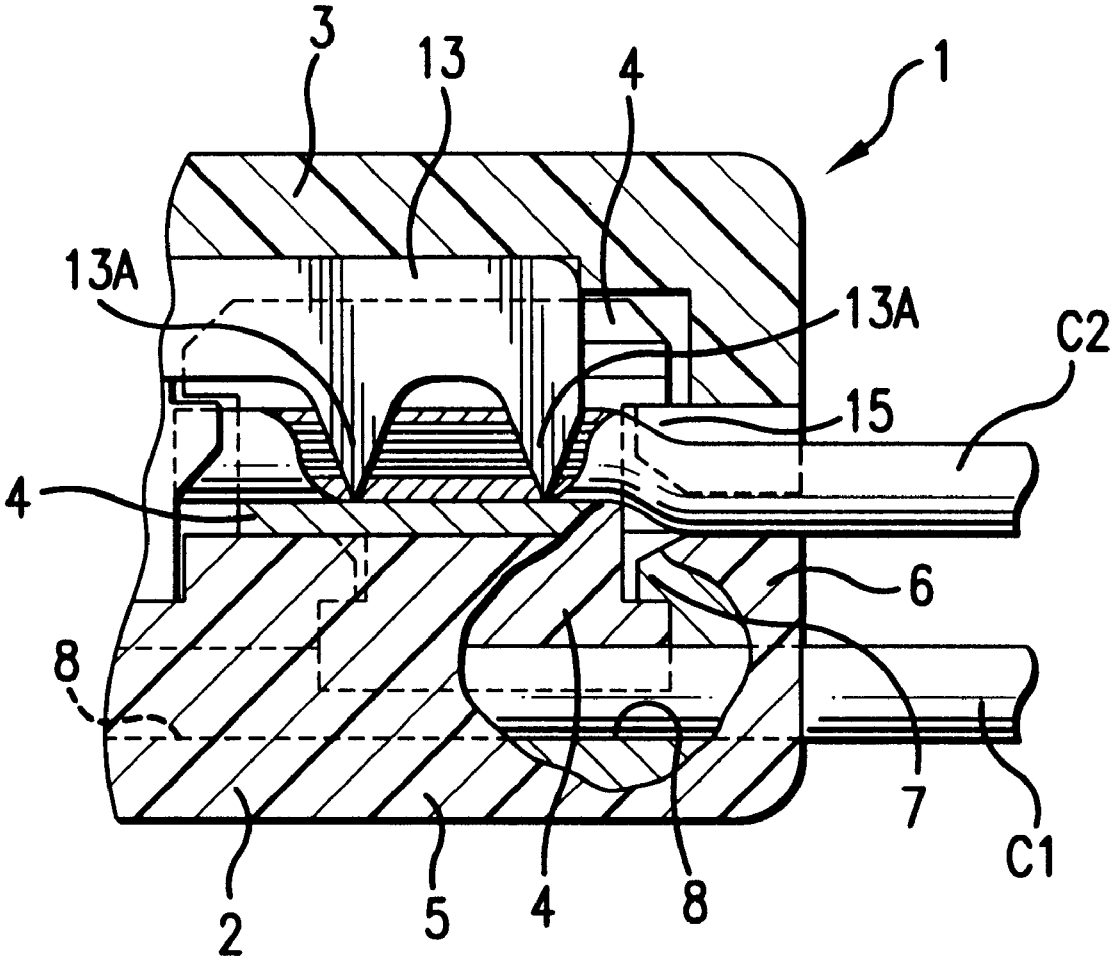
FIG. 1 is a sectional view of an electrical connector according to an embodiment of the invention.

In FIG. 1, an electrical connector 1 includes an arranging housing 2 and a holding housing 3. Both the housings 2 and 3 are united via an arranging member 4.

The arranging housing 2 has a bottom 5 and a side wall 6 surrounding the bottom 5 to define a cavity. A engaging hook 7 is provided on the upper inner edge of the side wall 6.

Figure 2:
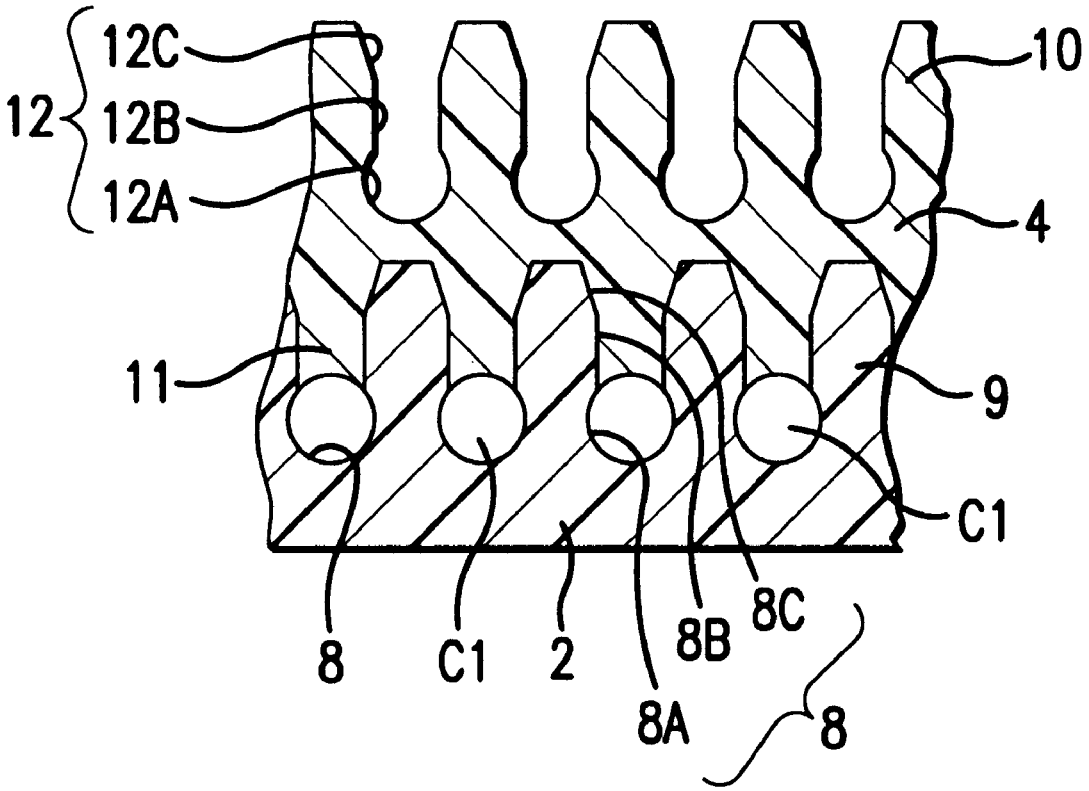
FIG. 2 is a sectional view of an arranging housing and an arranging member for the electrical connector.

In FIG. 2, a plurality of arranging grooves 8 are provided in the bottom 5 of the arranging housing 2 for arranging cables C1. Each of the arranging grooves 8 has a substantially circular bottom section 8A for receiving a cable C1, an intermediate section 8B extending upwardly from the bottom section 8A, and a guiding section 8C extending upwardly and outwardly from the intermediate section 8B. These arranging grooves 8 are defined by partition walls 9 provided between adjacent arranging grooves 8.

The arranging member 4 has a plurality of upward partition walls 10 and a plurality of downward guiding projections 11. Each arranging groove 12 defined by a pair of opposed partition walls 10 has a substantially circular bottom section 12A, an intermediate section 12B, and a tapered guiding section 12C. The guiding projections 11 have such a form as to be fitted into the arranging grooves 8 of the arranging housing 2. It is preferred that the length of the guiding projections 11 is such that when the guiding projections 11 are fitted in the arranging grooves 8, the lower faces of the guiding projections are brought into contact with the cables C1 in the arranging grooves 8 with a certain pressure but, alternatively, the guiding projections 11 may be just as long as to enter the guiding sections 8C of the arranging grooves 8.

Figure 3:
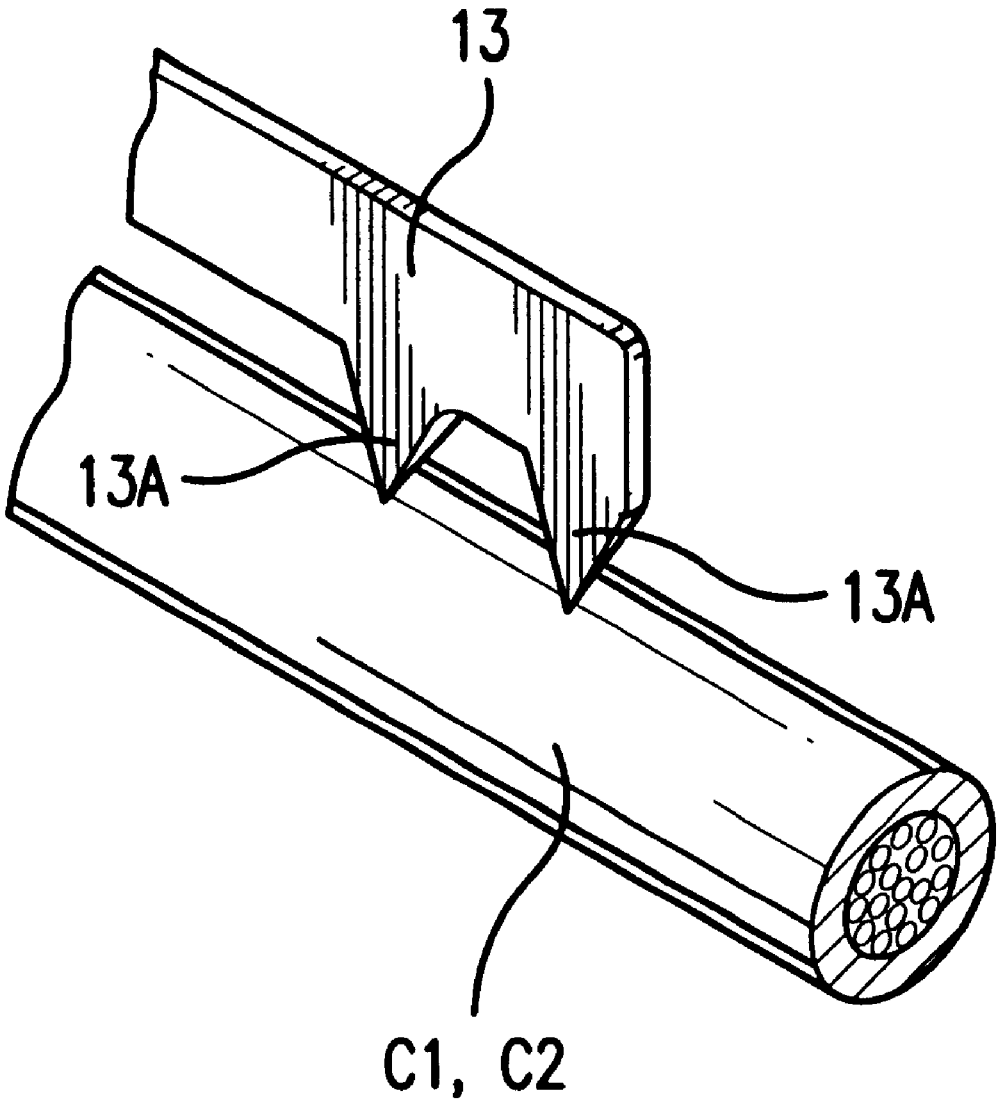
FIG. 3 is a perspective view of a contact element for the electrical connector.

The holding housing 3 has a cavity for accommodating the arranging member 4 and a plurality of contact elements 13. In FIG. 3, the contact element 3 is a press-connection terminal made by stamping a metal sheet to provide triangular connection portions 13A. In FIG. 1, only the contact element 13 press-connected to the upper tier cable C2 is shown, but contact elements press-connected to the lower tier cables C1 are also provided in the holding housing 3.

How to use the electrical connector will be described below.

(1) A plurality of cables C1 are press-fitted in the arranging grooves 8 of the arranging housing 2, with the arranging member 4 removed. The cables C1 are pressed into the bottom sections 8A via the guiding sections 8C and the intermediate sections 8B to form a lower tier of cables.

Figure 4:
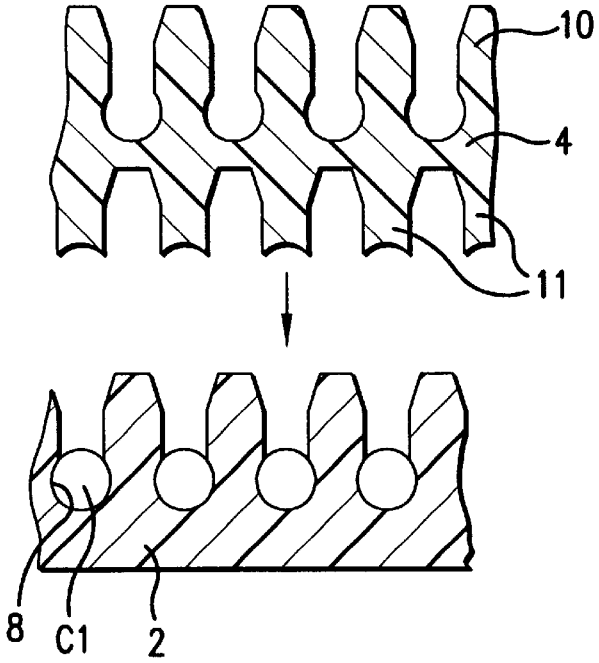
FIG. 4 is a sectional view of the arranging housing and the arranging member before union.

(2) In FIG. 4, the guiding projections 11 of the arranging member 4 are inserted into the guiding sections 8C of the arranging grooves 8, and the arranging member 4 is snapped by the engaging projection 7 of the arranging housing 2 and united with the arranging housing 2 such that the guiding projections 11 slightly press the cables C1 in the arranging grooves 8.

(3) A plurality of cables C2 are put into the arranging grooves 12 of the arranging member 4. That is, they are pushed into the bottom sections 12A via the guiding sections 12C and the intermediate sections 12B to form an upper tier of cables C2.

(4) The holding house 3 is snapped to the arranging member 4 by means of the engaging projection 15 such that the contact elements 13A are press-connected to the cables C1 and C2 at predetermined positions. The blade-like connection portions 13A of the contact elements 13 pierce into the stranded wires of the cables C1 and C2.

The arranging housing 2 and the holding housing 3 do not need any means for uniting each other because the arranging member 4 engages the engaging projections 7 and 15 of the arranging housing 2 and the holding housing 3, respectively.

Figure 5:
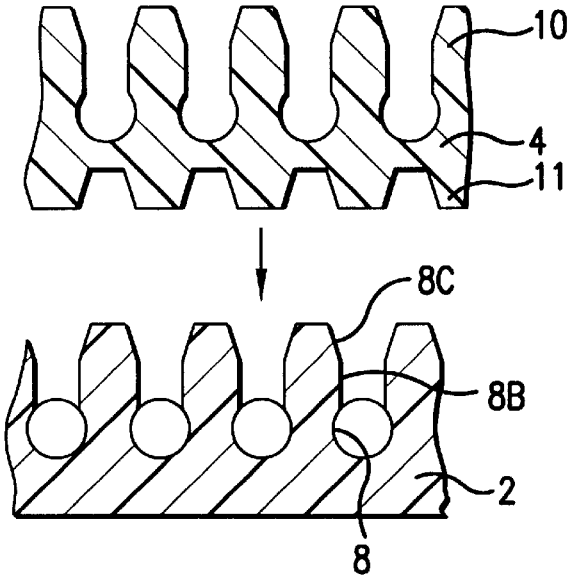
FIG. 5 is a sectional view of another arranging member for the electrical connector.

In FIG. 5, alternatively, the guiding projections 11 have a length to enter only the guiding sections 8C of the arranging grooves 8.

Figure 6:
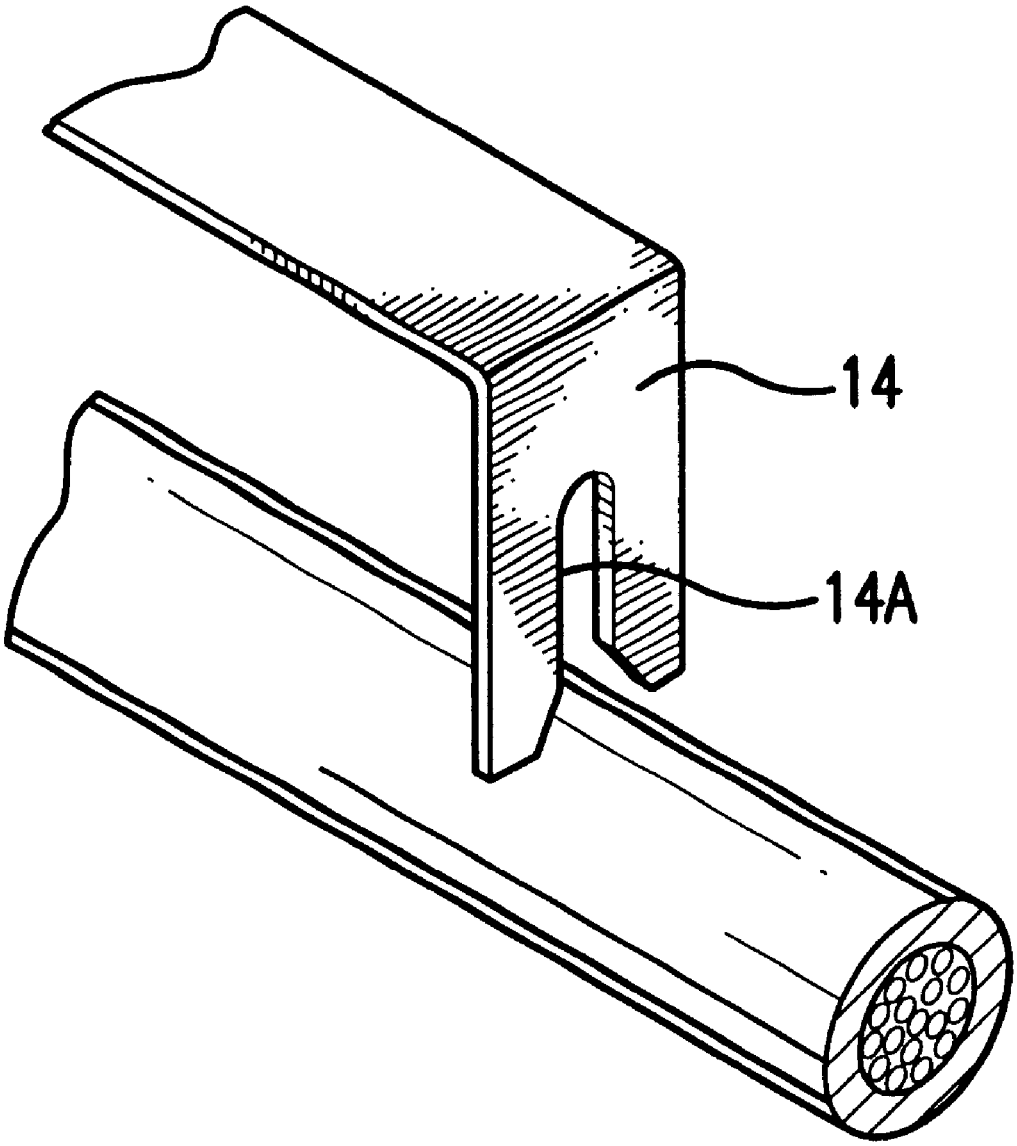
FIG. 6 is a perspective view of another contact element for the electrical connector.

In FIG. 6, alternatively, a contact element 14 has a press-connection groove 14A into which a cable is press-connected.

Figure 7:
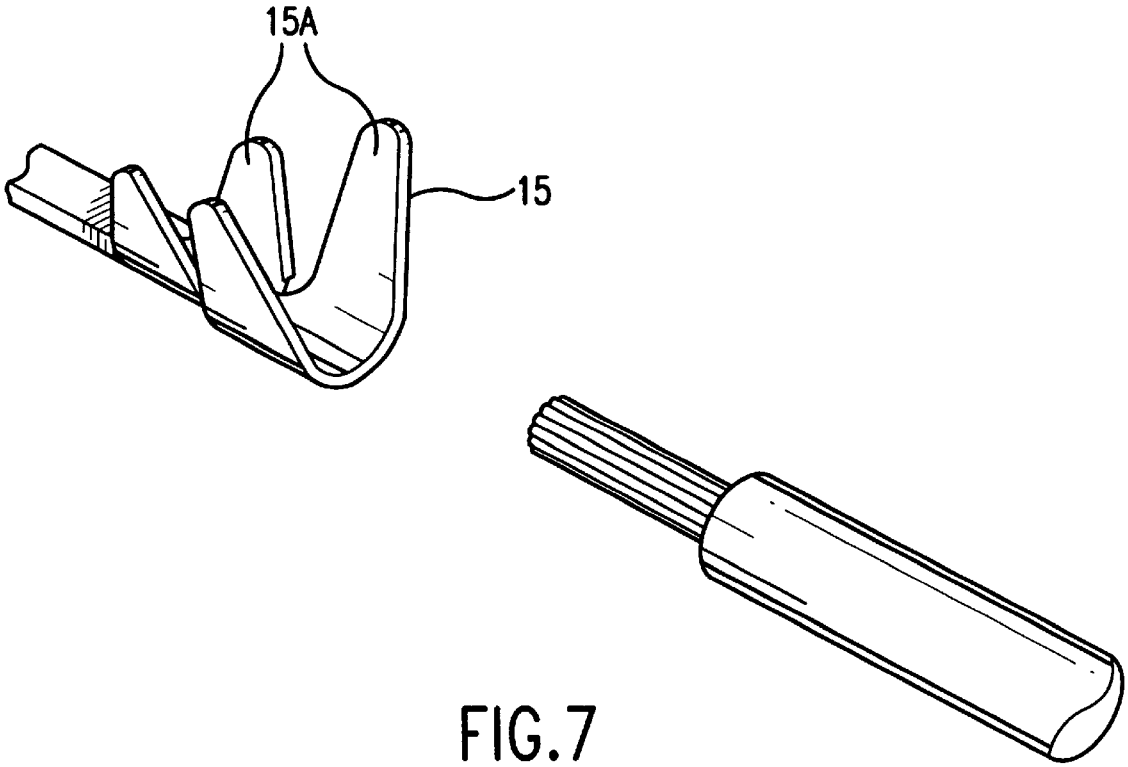
FIG. 7 is a perspective view of still another contact element for the electrical connector.
Figure 8:
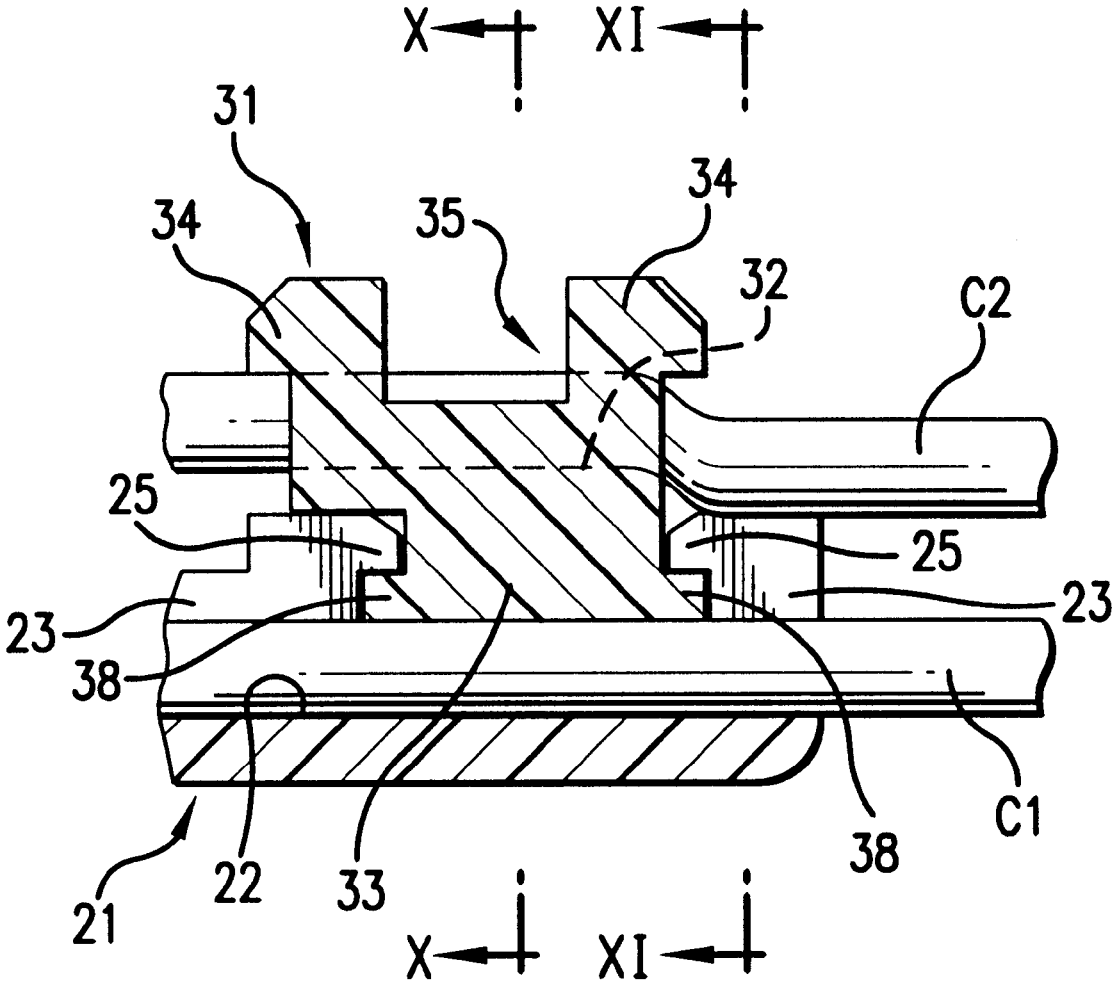
FIG. 8 is a sectional view of an electrical connector according to another embodiment of the invention.

In FIG. 7, alternatively, the contact element may be a crimping terminal 15 having crimping tabs 15A. In this case, the cables connected to crimping terminals 15 are arranged in the arranging grooves, and the holding housing is united with the arranging housing via the arranging member. It is possible to unite directly the arranging housing with the holding housing.

The holding housing may be omitted. Only the holding member is needed to press down the cables on the arranging member. If the holding power of the arranging grooves is satisfactory, the holding member may be omitted. By increasing the number of arranging members it is possible to increase the number of tiers of cables.

A second embodiment of the invention will be described with reference to FIGS. 8–11. In this embodiment, the guiding sections of arranging grooves and the engaging projections for pressing the lower cables are offset in the axial direction of the cables.

A plurality of arranging grooves 22 are provided in an arranging housing 21 for arranging a lower tier of cables C1. A plurality of pairs of upward projections 23 are provided on the arranging housing 21 in the axial direction of the cables C1. A receiving cavity 24 is defined by the pairs of upward projections 23 in a direction perpendicular to the axial direction. A plurality of pairs of engaging hooks 25 are provided on the tops of the pairs of upward projections 23. A plurality of tapered guiding sections 26 are provided on the upward projections 23 and communicate with the arranging grooves 22.

Figure 9:
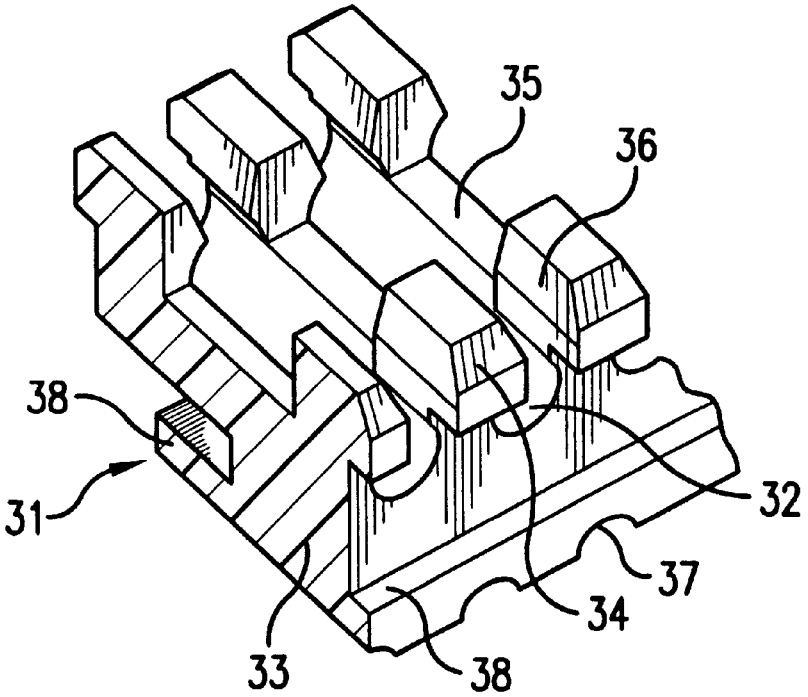
FIG. 9 is a perspective view of an arranging housing and an arranging member for the second electrical connector.
Figure 9:
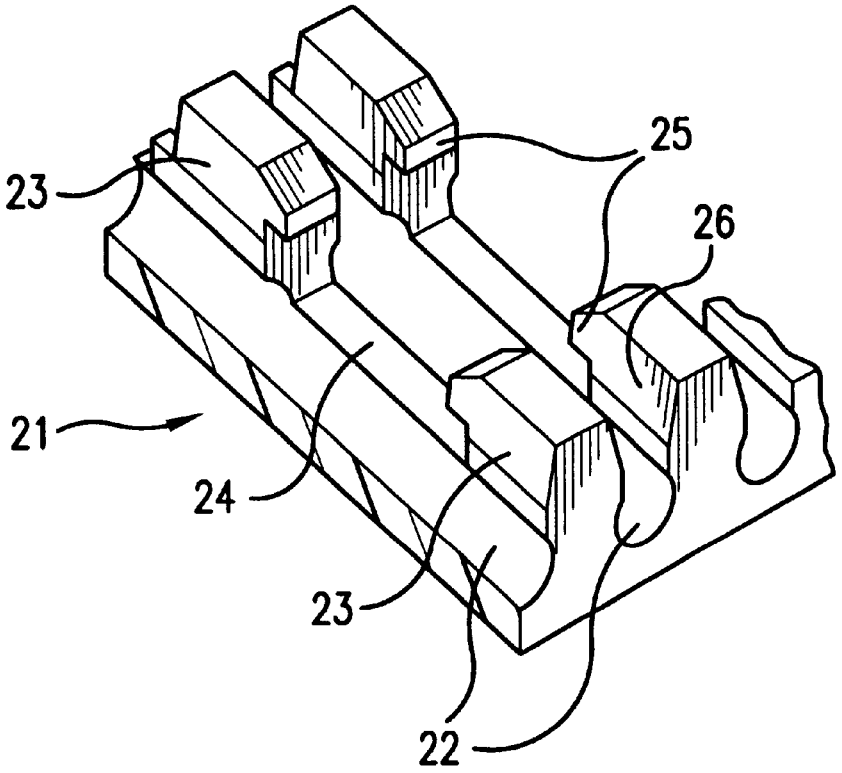
Figure 10:
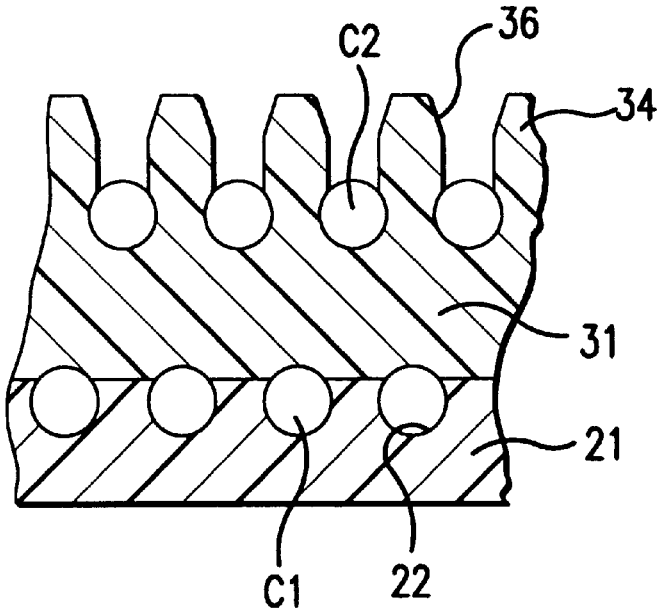
FIG. 10 is a sectional view taken along line X—X of FIG. 8.
Figure 11:
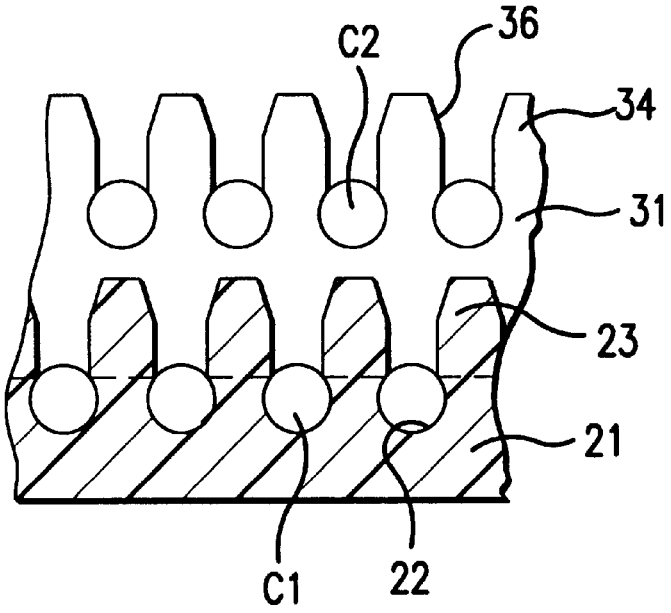
FIG. 11 is a sectional view taken along line XI—XI of FIG. 8.
Figure 12:
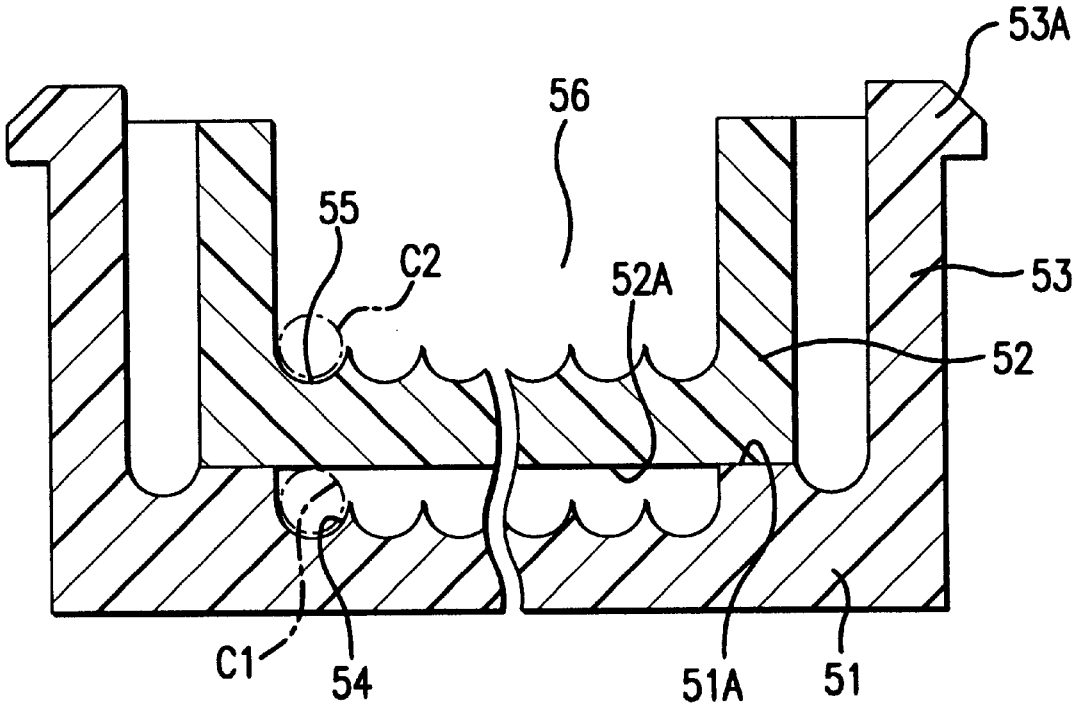
FIG. 12 PRIOR ART
FIG. 12 is a sectional view of a conventional connector.

In FIG. 9, an arranging member 31 has upper arranging grooves 32 for cables C2 and a lower engaging section 33. A receiving cavity 35 is defined by upward projections 34 to receive, if necessary, another arranging member. Similarly, the guiding sections 36 are also provided. A plurality of press grooves 37 are provided in the lower face of the engaging section 33 for pressing the lower tier cables C1 at predetermined positions. A pair of engaging flanges 38 are provided on the engaging section 33 in a direction perpendicular to the axial direction of cables C1.

The engaging section 33 of the arranging member 31 is put into the receiving cavity 24 of the housing 21 such that the engaging flanges 38 engage the engaging hooks 25 of the housing 21 for locking. The lower cables C1 are held down by the press grooves 37 of the engaging section 33 while the upper cables C2 are arranged in the arranging grooves 32. The engaging section 33 of the arranging member 31 and the guiding sections 26 of the arranging grooves 22 are offset in the axial direction of cables so that when the arranging grooves 32 are provided closely to the arranging housing 21, the strength of the arranging member 31 is maintained. Thus, the arranging grooves 32 are lowered to reduce the height of the connector.

In this invention, the shape of contact elements is not essential. The holding housing may be omitted. By increasing the number of arranging members, it is possible to increase the tiers of cables.

As has been described above, according to one aspect of the invention, the arranging member has the guiding sections which enter the arranging grooves for the lower tier of cables so as to assure holding the cables in the arranging grooves while reducing the height of the arranging member and the connector. The guiding projections are readily inserted into the arranging grooves so that the arranging operation becomes easy.

According to another aspect of the invention, the guiding sections of the arranging grooves and the engaging section for pressing the lower cables are offset in the axial direction of cables so that the arranging grooves for the upper cables are provided at a lower level without losing the strength of the arranging member, thus reducing the height of the arranging member.

What is claimed is:

1. A multiple tier electrical connector, comprising:

an arranging housing having a plurality of lower arranging grooves for holding a lower row of cables;

a plurality of pairs of projections on said arranging housing to form a receiving cavity between each pair of said projections in an axial direction of said lower arranging grooves;

a plurality of guiding sections provided on said projections and communicating with said lower arranging grooves; and an arranging member having a plurality of upper arranging grooves for receiving an upper row of cables and a downward engaging section for entering said receiving cavity to thereby provide a low-profile electrical connector without losing strength of said arranging member.

* * * * *